US005226587A

United States Patent [19]

Eisman et al.

[11] Patent Number: 5,226,587

[45] Date of Patent: Jul. 13, 1993

[54] FOOD CARTON

[75] Inventors: Larry Eisman, Elkins Park; Joel B. Corder, Pottstown, both of Pa.

[73] Assignee: Dopaco, Inc., Downingtown, Pa.

[21] Appl. No.: 986,467

[22] Filed: Dec. 7, 1992

Related U.S. Application Data

[63] Continuation-in-part of Ser. No. 866,508, Apr. 10, 1992, which is a continuation-in-part of Ser. No. 833,114, Feb. 10, 1992, Pat. No. 5,188,284.

[51] Int. Cl.[5] ..... B65D 5/66; B65D 43/02

[52] U.S. Cl. ..... 229/110; 229/114; 229/125.27; 229/125.29; 229/148; 229/906

[58] Field of Search ..... 229/109, 110, 112-114, 229/125.27, 125.29, 146, 148, 150, 178, 901, 902, 906

[56] References Cited

U.S. PATENT DOCUMENTS

| | | | |
|---|---|---|---|
| 2,028,677 | 1/1936 | Lupton . | |
| 2,307,076 | 1/1943 | Ray . | |
| 2,499,780 | 3/1950 | Rottman . | |
| 2,618,429 | 11/1952 | Donnell | 229/125.29 |
| 2,785,845 | 3/1957 | Stenger . | |
| 2,819,833 | 1/1958 | Sauer . | |
| 2,837,261 | 6/1958 | Stenger . | |
| 2,925,213 | 2/1960 | Zukoski . | |
| 2,956,720 | 10/1960 | Rindal . | |
| 3,027,062 | 3/1962 | Huss et al. | 229/114 |
| 3,410,475 | 11/1968 | Wagner | 229/178 |
| 3,623,650 | 11/1971 | Watts | 229/148 |
| 4,018,378 | 4/1977 | Persson | 229/109 |
| 4,516,718 | 5/1985 | Forbes, Jr. | 229/148 |
| 4,620,666 | 11/1986 | Lacasa et al. | 229/110 |
| 4,700,843 | 10/1987 | Cohen | 229/906 |
| 4,765,534 | 8/1988 | Zion et al. | 229/109 |
| 4,804,136 | 2/1989 | Hall | 229/906 |
| 4,809,908 | 3/1989 | Keefe et al. | 229/150 |
| 4,856,707 | 8/1989 | Lorenz | 229/114 |
| 4,877,178 | 10/1989 | Eisman | 229/114 |
| 4,930,681 | 6/1990 | Fultz et al. | 229/906 |
| 5,037,026 | 8/1991 | Hanko | 229/114 |
| 5,039,003 | 8/1991 | Gordon et al. | 229/120.32 |
| 5,060,851 | 10/1991 | Lorenz | 229/125.29 |
| 5,110,039 | 5/1992 | Philips | 229/110 |
| 5,118,032 | 6/1992 | Geho | 229/110 |
| 5,118,033 | 6/1992 | Kula | 229/148 |
| 5,160,081 | 11/1992 | Beales | 229/114 |

FOREIGN PATENT DOCUMENTS

| | | | |
|---|---|---|---|
| 2312859 | 9/1974 | Fed. Rep. of Germany | 229/148 |
| 2652566 | 4/1991 | France | 229/125.29 |
| 641292 | 6/1962 | Italy | 229/125.29 |
| 528289 | 10/1940 | United Kingdom | 229/125.29 |

*Primary Examiner*—Gary E. Elkins

*Attorney, Agent, or Firm*—Dennison, Meserole, Pollack & Scheiner

[57] ABSTRACT

A carton including a hexagonal tray with a complementary hexagonal cover integrally hinged thereto for closing thereover. A dual locking system between the tray and cover includes projecting locking lugs coplanar with the front wall of the tray and extending beyond adjoining tray side walls for interlocking engagement with corresponding lugs on side walls of the cover which extend beyond the cover front wall. The locking assembly also includes headed upwardly extending tabs on selected tray side walls which engage through corresponding slots in the cover top panel to lock the top panel downwardly against the upper edges of the side walls from which the tabs project.

11 Claims, 3 Drawing Sheets

FOOD CARTON

This is a continuation in part of application Ser. No. 07/866,508, filed Apr. 10, 1992, for FOOD CARTON WITH COVER, pending, which is a continuation in part of application Ser. No. 07/833,114, filed Feb. 10, 1992, for CARTON WITH LUG LOCKED TRAY AND COVER, U.S. Pat. No. 5,188,284 issued Feb. 23, 1993.

BACKGROUND OF THE INVENTION

Principal goals for cartons or containers used in the fast food industry wherein only a single use is contemplated include the formation of cartons to both properly and safely accommodate the foodstuffs, and to in themselves be an economical and practical product.

The carton, when open, must allow for quick and easy introduction of the food product. The carton must also be able to both close and lock in a positive manner, and easily open for access to the carton contents. Another desirable feature, particularly in preassembled fast food cartons folded from blanks of paperboard or the like, is the capability for a compact nesting of the cartons for storage and shipment. As an example of cartons incorporating the above features, attention is directed to applicant's prior U.S. Pat. No. 4,877,178, issued Oct. 31, 1989.

While cartons for fast food and the like are provided in a variety of sizes to generally correspond with the foodstuffs to be received therein, such cartons are, as in the above patent, conventionally of rectangular configuration and without regard to the specific shape of the goods to be received. For example, notwithstanding that the conventional pizza is circular, the conventional pizza box is square. In such situations, there is wasted space within the carton and the use of excess paperboard in the formation of the "oversized" carton.

The parent applications teach the provision of cartons which are configured for the specific accommodation of the conventional round pizza or similarly shaped food item. The prior cartons, utilizing straight sides for convenience in forming, are provided with a number of sides, more than four and preferably six, to approach a circular configuration, thus minimizing excess interior space and reducing the amount of material utilized while at the same time providing the basic simplicity and economical construction of a conventional rectangular "hamburger" carton.

In view of the multiple sides provided on the preferred hexagonal carton, there is a tendency when handling the full carton in one hand to grasp the box at any point about the periphery. This, in view of the internal weight of the pizza and the rather flexible nature of the carton, tends to cause a slight flexing or distortion of the loaded carton as might tend to at least partially disengage the cover from the tray. As such, and in view of the relatively large surface area of a pizza box as compared to a much smaller hamburger box, it is particularly important that a positive interlock be provided between the tray and the cover closed thereon. The provision of a positive and effective locking arrangement between the tray and cover has been a goal of applicant's previous efforts.

SUMMARY OF THE INVENTION

The carton of the present invention, preferably hexagonal, is a two component carton having substantially straight sides with obtuse angles therebetween and comprising a tray with a cover hinged thereto for selective movement between an open position outward of the tray and a closed position overlying and locked to the tray.

A principal object of the invention is the provision of a carton which is particularly adapted to accommodate circular pizza pies and the like in a secure and protective manner without excess or unnecessary internal space, thereby minimizing the amount of material required as well as the physical bulk of the carton.

Other significant objects of the invention include the provision of a lock assembly comprising two distinct forms of locks which automatically engage upon a closing of the hinged cover over the tray. It is a significant object that the combined locks uniquely function to retain the cover in its closed position regardless of any stress the carton might undergo during the normal handling of the carton, and which, at the same time, are easily and quickly released for access to the contents of the carton.

The locks are associated with the forward portion of the carton in generally opposed relation to the integrally hinged rear walls of the carton with a release of the lock assembly being easily effected from the front of the carton, notwithstanding the positive locking arrangement which precludes any possibility of accidental release.

The provision of two distinct lock types is also significant in providing a back up locking system which allows a degree of repeated opening and closing of the carton in that should either form of lock become partially disabled, because of the basic nature of the cardboard of the carton from which the locks are integrally formed, an effective locking of the carton, albeit without the maximum security of the dual locking system, is still possible.

Related objects include the provision of a carton which, while formed of conventional paperboard material, provides enhanced strength, structural stability and, through the elimination of excess internal volume, an increased ability to retain heat.

Further objects of the invention include the provision of a tray and cover relationship wherein, in the closed carton, there is a peripheral overlap and multiple readily engaged and disengaged positive locks to effectively retain and protect the received product, while allowing for ready access thereto.

Basically, the carton of the invention is of the type commonly referred to as a clam-shell carton wherein the tray and cover are integrally hinged along a common edge for a selective movement of the cover between an open position outwardly pivoted from the tray and a closed position overlying and engaged with the tray.

The tray and cover each include a base panel and integral generally upright walls peripherally thereabout. The walls are generally planar and oriented at included obtuse angles to the adjacent walls to define a generally circular enclosure as opposed to the more conventional rectangular box. In the preferred embodiment, both the tray and cover will be of hexagonal configuration with six generally equal length walls edge joined to define six internal corners of 120°.

The tray and cover both have low inner walls integrally joined along a common top edge thereof to define a hinge therebetween. The cover includes a pair of low rear side walls extending outward from the cover inner wall at the opposed ends thereof at obtuse angles. A pair of high forward side walls extend outward from the outer ends of the low side walls, also at obtuse angles thereto, and in turn have the outer ends thereof joined by an outermost low front wall. Each of the high side walls includes a coplanar lug at the outer end thereof above and extending beyond the adjacent low front wall.

The tray has a pair of high rear side walls extending outward and at obtuse angles from the opposed ends of the low tray inner wall. The outer ends of these high side walls in turn join, at obtuse angles, to a pair of outwardly extending higher forward side walls, the outer ends of which are joined by a high front wall. Each end of the tray front wall includes a coplanar projecting lug above and extending across the forward ends of the adjacent forward side walls. As will be recognized, other than for the hinge joined inner walls, the arrangement of the walls of the tray and cover are such whereby upon a closure of the cover over the tray, each wall will align with and overlap a relatively higher or lower wall. At least selected ones of the walls are slightly outwardly inclined to simplify the overlapping engagement thereof, and to allow for compact nesting of the empty cartons.

The projecting lugs form one of the dual locking systems and, upon a closing of the cover and through a slight flexing of the lugs or walls, snap lock into engagement with each other, providing a visual indication of a proper locking of the cover to the tray. Disengagement of the lugs is easily effected in an obvious manner by flexing selected ones of the outermost or forward walls.

The second locking system of the lock assembly includes an integral locking tab extending upwardly from the generally convex upper edge of each of the forward side walls of the tray. These tabs, within the plane of the corresponding side walls, include enlarged heads joined to the upper edges by relatively narrower necks which form a generally "arrow" or "spearhead" configuration with locking shoulders.

The cover, through the top panel thereof and immediately adjacent the corresponding forward side walls, include generally similarly configured locking slots which automatically receive the locking tabs upon a closing of the cover over the tray with the tabs snapping into locked position and providing for a direct locking engagement between the upwardly directed walls of the tray and the overlying top panel of the cover. The tab walls of the tray, that is the forward side walls thereof, are slightly inwardly bowed or convex relative to the interior of the tray to more closely orient the tabs vertically and perpendicular to the overlying cover top panel to thus ensure automatic positioning within the corresponding forward side walls of the cover and engagement with the cover slots. As a variation to the provision of the locking tabs on the two forward side walls of the tray, in small boxes, it is conceivable that a single upwardly extending locking tab can be provided centrally along the front wall for cooperation with the edge positioned locking lugs.

The hexagonal configuration illustrated is preferred as an effective means to closely approximate the circular configuration of a pizza and thus reduce the material required for the carton, the size of the carton and unneeded interior space. However, other polygonal configurations of greater than four sides, utilizing obtuse angles, and following a generally circular layout, might be considered.

It will be noted that the length of the individual sides of the hexagonal carton are relatively shorter than the sides of a conventional rectangular pizza box of a size necessary to contain a predetermined size pizza. As such, both the walls themselves and the overall carton, for the same thickness of paperboard material or the like, will be inherently stronger and afford greater protection to the product therein. Also, while the above described polygonal configuration of the carton rather closely conforms to the circular configuration of a pizza, actual engagement, assuming a pizza of a size substantially equal to the interior of the carton, will be at intermediate portions of the walls as opposed to full edge to wall contact as might occur in a completely circular carton. As such, the pizza will be largely cushioned against any damage resulting from an inward crushing of the carton edge.

A further possible benefit residing in the hexagonal configuration of the tray is the possibility of utilization of the opposed angles as a guide for the cutting of the pizza into triangular pieces for serving.

Additional objects and advantages of the invention are considered to reside in the details of construction as will be more fully hereinafter presented.

DESCRIPTION OF PREFERRED EMBODIMENTS

Figure 2:
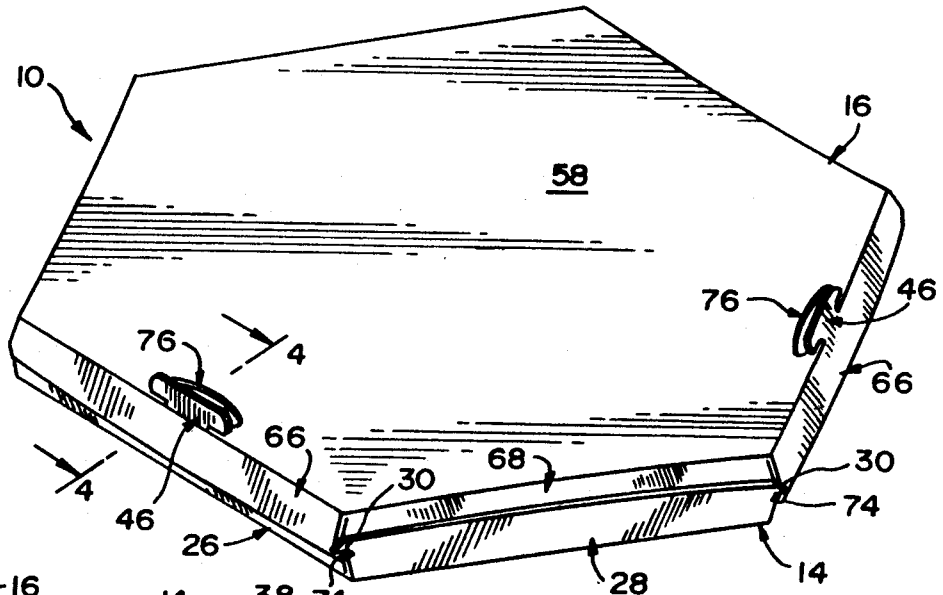
FIG. 2 is a perspective view of the closed carton illustrating the top, front and side thereof.

Referring now more specifically to the drawings, the carton or box 10, in the preferred embodiment folded from a unitary blank 12 as illustrated in the drawings, includes two components, a tray 14 and cover 16.

The tray 14 includes a base panel 18 of hexagonal configuration with six generally equal length edges defining six spaced interior angles of approximately 120°.

Substantially planar walls are integrally formed with the base panel 18 coextensive with and along the edges thereof and extend upwardly therefrom, defining a continuous wall means about the tray 14. The walls comprise a low rear or inner wall 22, first rear side walls 24 relatively higher than said rear wall 22 and extending at obtuse angles from the opposed ends of the rear wall 22, second forward side walls 26 generally higher than said rear side walls 24 and joined to the outer ends of the rear side walls 24 and extending at similar obtuse angles therefrom, and an outer or front wall 28 of generally equal height with said rear side walls and joined to and extending transversely between the outer ends of the high forward side walls 26. The outer wall 28, in the preferred hexagonal embodiment, parallels the inner wall 22.

The outer or front wall 28 includes a coplanar tab 30 on each end thereof which overlies and intersects the adjacent end of the adjacent forward side wall 26 and extends therebeyond to define a locking lug.

The inner edge 32 of front wall 28 at base 18 is linear or straight. The outer free edge 34 is slightly convex with the front wall 28 in the erected tray bowing slightly outward to a progressively greater depth from inner edge 32 to outer edge 34.

Each lug, noting FIG. 2, includes an inclined or beveled upper edge 36 for facilitating an engagement of complementary lugs of the cover as shall be described subsequently, and also a lower locking shoulder.

The rear side walls 24 of the tray 14 are similar to the front wall 28 in that each includes a linear base or inner edge 36 at the base 18, and a slightly convex free outer edge 38, thereby, in the erected carton, slightly outwardly bowing.

The forward side walls 26 each include an inner edge 40 integral with the base 18 along the corresponding edge thereof and slightly inwardly convex whereby the forward side walls 26 will, in the erected tray, bow slightly inward.

The free upper or outer edge of each forward side wall 26 includes a linear central section 42 in a plane paralleling the plane of the base 18 and of a length approximately equal to one-half of the length of the forward side wall 26. The upper edge, to each side of the central section 42, includes linear end sections 44 inclined downwardly to the opposed ends of the forward side wall 26. The outer edge end section 44 which extends to the front wall 28 terminates below the locking lug 30 at the juncture between the walls.

The outer edge central section 42 of each forward side wall 26 is at a greater elevation, relative to the base panel 18, than the upper edges of the remaining tray walls for positioning and stabilizing engagement with the overlying cover 16 as shall be described subsequently.

A locking tab 46, integral and coplanar with each forward side wall 26, projects upwardly from a central portion of the central upper edge section 42. Each tab 46 includes a transversely enlarged head 48 joined to the corresponding central section 42 by a narrow neck 50 with the head 48, to each side of the neck 50, presenting downwardly directed shoulders 52 parallel to and spaced from the central upper edge section 42 to define a notch 54 therebetween.

The cover 16 is similarly configured to overlie and cooperate with the tray 14, and includes a hexagonal top or top panel 58 with edge joined walls extending from the six edges of the top panel 58 and inclining slightly outward relative thereto.

Figure 1:
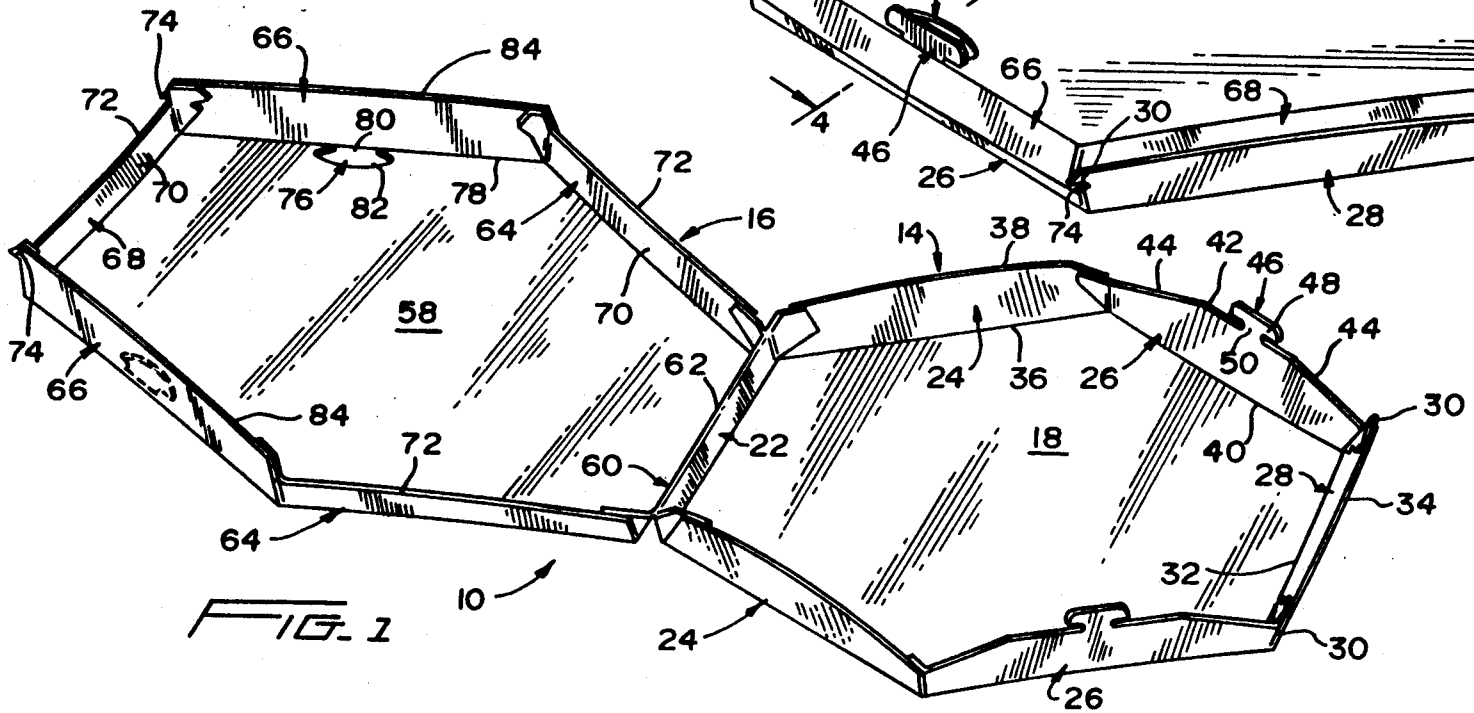
FIG. 1 is a perspective view of the open carton of the invention with the hinge joined tray and cover folded from a unitary blank.

The walls of the cover 16 extend at approximately 120° to each other, and include a low rear or inner wall 60 which is integrally joined for the full length of the upper edge thereto to the corresponding upper edge of the inner wall 22 of the tray 14 along a fold line 62 which defines a hinge allowing for a selective pivoting of the cover 16 between the open position of FIG. 1 and the closed position of FIG. 2.

Two low rear side walls 64, joined to the opposed ends of the inner wall 60, extend forwardly to outer ends in turn joined to forwardly extending high forward side walls 66. The outer ends of the forward side walls 66 are joined by a front or outer low wall 68 extending therebetween and paralleling the low inner wall 60.

The two low rear side walls 64 and the low front wall 68 may have slightly convex inner edges 70 at the integral joinders with the top 58, and slightly concave outer free edges 72 so as to in the erected cover 16, bow slightly inward and thereby facilitate nesting within the corresponding walls of tray 14.

The forward ends of the high forward side walls 66 are provided with integral coplanar projecting lugs 74 which overlie, intersect and extend beyond the adjoining ends of the low front wall 68. The difference in height between the high forward side walls 66 and low front wall 68 is substantially that of the height of the lugs 74.

The lugs 74, similar to lugs 30, include inclined or beveled outer edges and inner locking shoulders.

In order to accommodate the upwardly projecting locking tabs 46 of the tray 14, the top or top panel 58 of the cover 16 is provided with two locking slots 76 extending generally perpendicularly inward from the substantially linear inner edges 78 of the high forward side walls 66 at central points therealong and so positioned as to align with the locking lugs 46 upon a closing of the cover over the tray.

Figure 3:
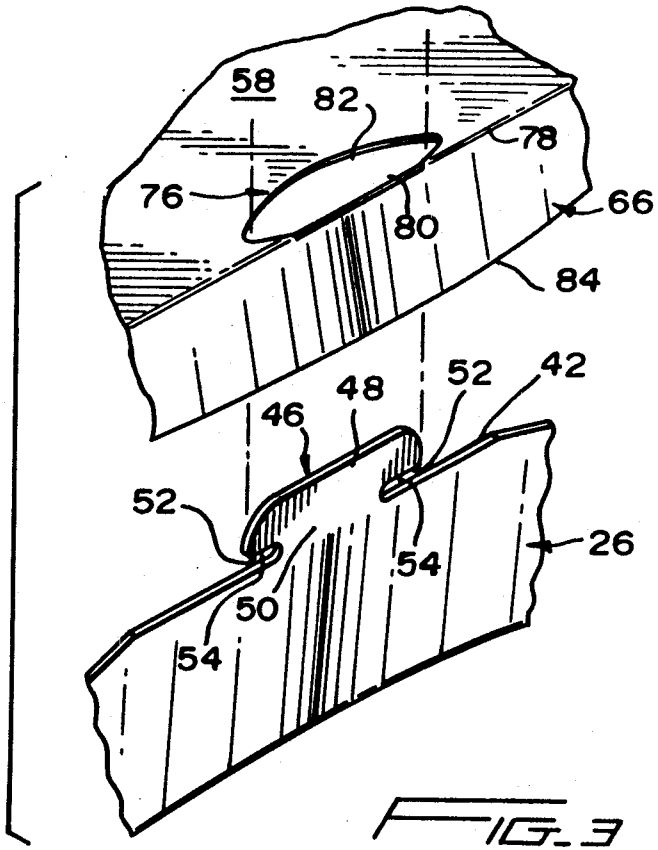
FIG. 3 is an exploded perspective detail of the tab and slot lock of the carton.
Figure 6:
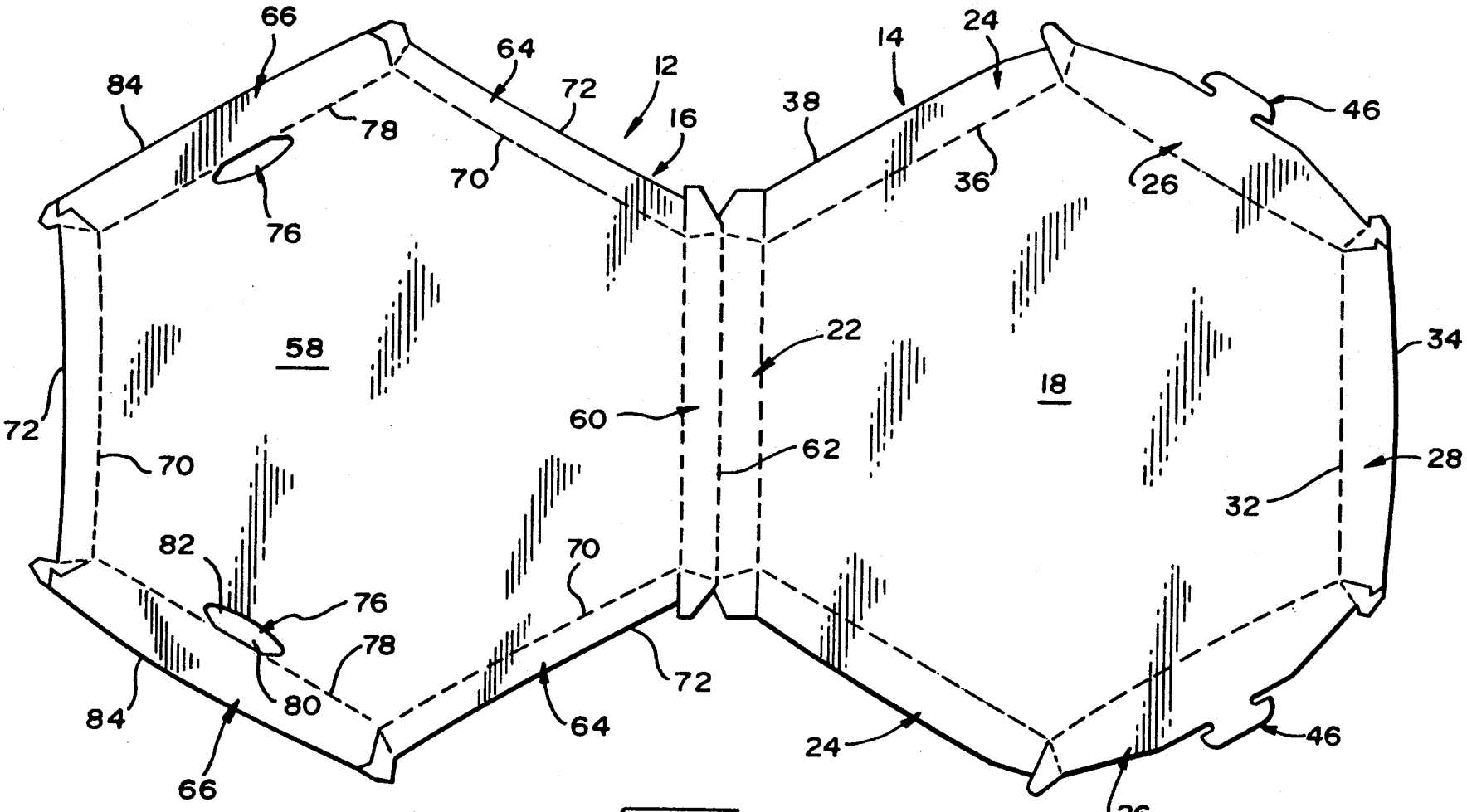
FIG. 6 is a plan view of the unitary blank from which the carton is folded.

Each locking slot 76, noting FIG. 3 in particular, includes a narrowing or tapering neck 80 of a width at the adjacent side wall 66 adapted to closely receive a tab neck 50 therein, and a transversely enlarged head 82 adapted to closely receive a tab head 48 therethrough. To facilitate alignment of the tabs 46 and tray walls 26 inward of cover walls 66, the outer free edge 84 of each wall 66 may be slightly convex to produce a slight outward bowing of the wall 66.

Upon a closing of the carton cover 16 over the tray 14, the two rear side walls 64 of the cover will align immediately inward of the two rear side walls 24 of the tray. The two forward side walls 66 of the cover will align with and outwardly overlie the two forward side walls 26 of the tray, and the front wall 68 of the cover will align with the front wall 28 of the tray immediately inward thereof.

As the walls of the cover and tray are moved into engagement with each other, the corresponding projecting tray and cover locking lugs 30 and 74, through the beveled outer edges thereof, engage and slide past each other, such being allowed by the inherent flexibly resilient nature of the material of the carton.

Substantially simultaneously with the locking engagement of the lugs, the two tabs 46 engage through the locking slots 76. The arrangement of the forward side walls of the cover and tray are such whereby the tabs 46, in an unstressed condition, align with the tapered necks 80 of the slots 76 along the inner edges 78 of the cover forward side panels 66. As the cover is moved downward into locking engagement, the tabs 46 engage the top panel 58 and, due to the inherent resilient flexibility of the paperboard material of the carton, flex slightly inward to align the tab and slot heads and allow for passage of the tab heads 48 through the corresponding slot heads 82. Upon passage of the tab heads through the slot heads, the inherent flexible resiliency of the tabs will return the tabs to their initial or unstressed position with the necks of the tabs received within the necks of the slots adjacent the walls 66 and with the tab heads overlying the cover top panel 58 to the opposed sides of the corresponding slots 76 whereby direct withdrawal of the tabs from the slots, without specific manual manipulation of the tabs, is prevented. This engagement is effected substantially simultaneously with the engagement of the front wall lugs.

The tapered sides of the slot necks 80 guide and facilitate movement of the tab heads 48 toward alignment with the slots heads 82 for passage therethrough. This movement can be further facilitated by a slight rounding of the ends of the tab heads 48 as illustrated. The tapered slot necks 80 also facilitate return movement of the tabs 46 toward their locked positions adjacent cover walls 66.

With the tabs 46 so engaged, the portions of the top panel 58 to the opposite sides of the slot necks 80 are received within the opposed tab notches 54 and the linear central section 42 of the upper edge of each wall 26 to the opposite sides of the tab 46 thereon receives and supports the adjoining portion of the cover top panel 58, thereby providing a limit to the downward movement of the cover on the tray and providing a stable and rigidifying support for the cover and in particular the top panel thereof.

Figure 5:
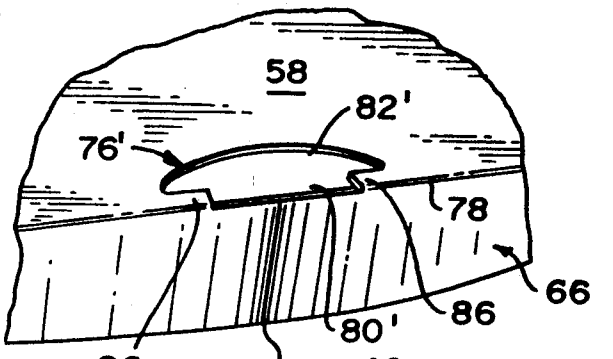
FIG. 5 is a perspective detail illustrating a variation in the configuration of the slot.
Figure 4:
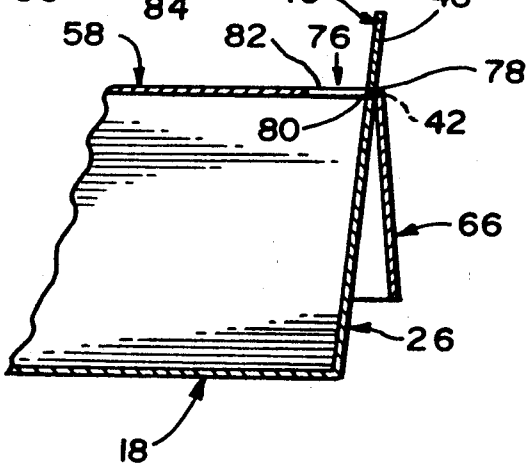
FIG. 4 is a cross section detail on line 4—4 of FIG. 2 of the closed tab and slot lock.

Noting FIG. 5, as a variation each of the locking slots 76' can be formed with the neck 80' having opposed parallel sides stepped inward from the lateral ends of the slot head 82' to define shoulders 86. These shoulders 86 will provide for a slight strengthening of the cover top panel 58 to each side of the slot 76' adjacent the folded edge 78, and provide for a greater area of engagement for the corresponding locking tab 46.

The previously referred to slight inward or outward bowing of selected ones of the walls facilitates a proper and automatic positioning of the walls relative to each other as the cover closes over the tray. The combined locking assembly, including both the slot received tabs and the interengaging lugs provide for a positive locking of the cover to the tray against any possibility of accidental opening of the carton. Rather, a positive manual manipulation, utilizing the inherent flexibility of the material of the carton, is required to disengage and open the cover. This manual manipulation notwithstanding the provision of two locking systems, can be readily and easily effected. As will be appreciated, the dual locking system provides for an interlocking of the tray and cover walls with each other at the forward portion of the carton. The tab locks interlock the top panel of the cover itself directly to the walls of the tray, and at the same time, through the linear upper edges of the tab supporting walls of the tray, provide a stable base against which the top panel of the cover engages. It will also be noted that the slight bowing of the tab walls 26 in particular provide for enhanced strength and stability as a support for the top panel.

As will be apparent from the drawings, the carton is preferably folded from a unitary blank of paperboard or the like. The blank 12 is illustrated in FIG. 5 wherein the components of the carton have been designated by like reference numerals for purposes of illustration and comparison.

Briefly, the base and top panels 18 and 58 are integrally joined along fold lines to the inner low walls 22 and 60 which are in turn integrally joined along the hinge forming fold line 62. Each of the remaining walls is similarly integrally joined along the corresponding edges of the associated panels by fold lines. Glue flaps are integral with and foldable from the opposed ends of the selected walls to overly and bond to adjacent walls in the erected carton. As will be noted, each of the lugs 30 and 74 can be reinforced by an overlying one of the glue flaps.

While the preferred embodiment of carton or pizza box is hexagonal with equal sides, and folded from a unitary sheet of paperboard as above described, other polygonal configurations, wherein most or all of the walls extend at obtuse angles to each other to define a generally circular configuration may also be feasible. Similarly, materials other than paperboard might also be used.

Basically, the preferred embodiment provides a pizza box which closely conforms to the conventional circular configuration of a pizza to minimize material and reduce excess interior space, thus achieving advantages inherent thereto including enhanced heat preserving capability and reduced material expense. In conjunction with the specific configuration of the pizza box, a primary purpose of the invention is the provision of a dual locking system with exposed interengaging locks at multiple spaced points thereabout to ensure a proper closure and sealing of the carton, notwithstanding the other than the conventional square configuration thereof.

The foregoing is considered illustrative of the principles of the invention. As modifications and variations may occur to those skilled in the art, it is not desired to limit the invention to the exact construction shown and described. Rather, the invention is to only be limited by the scope of the claims following hereinafter.

We claim:

1. A carton comprising a tray and a cover selectively movable to a position overlying and closing said tray; said tray including a base panel with a plurality of upstanding peripheral walls having adjacent ends defining corners spaced about said tray, said cover including a top panel with a plurality of depending peripheral walls having adjacent ends defining corners spaced about said cover, one of said walls of said tray and one of said walls of said cover comprising rear walls integrally joined along a fold line defining a common outer edge for a pivotal movement of said cover between said position overlying and closing said tray and a second position outwardly pivoted from said tray, the remaining walls of said tray and cover being forward of said rear walls, a first one of said tray walls forward of said tray rear wall having at least one tray locking lug formed generally coplanar therewith and extending outwardly therefrom at an angle across an adjacent second one of said tray walls forward of said tray rear wall at a defined corner therebetween, a first one of said cover walls forward of said cover rear wall having at least one cover locking lug formed generally coplanar therewith and extending outwardly therefrom at an angle across an adjacent second one of said cover walls forward of the cover rear wall at a defined corner therebetween, said cover locking lug being releasably interlocked with said tray locking lug when said cover is in said position closing said tray, said interlocked cover and tray lugs extending at an angle across each other, at least one of said tray walls adjacent said tray locking lug having an upper free edge with a locking tab projecting upwardly therefrom, said cover top panel having a locking slot defined therethrough and receiving said tab when said cover is in said position closing said tray, said tab interlocking with said cover top panel to preclude opening movement of said cover relative to said tray.

2. The carton of claim 1 wherein said tray wall upper free edge, in the closed position of said cover, engages against and supports said cover top panel, said locking tab including an enlarged head overlying said cover top panel whereby said top panel is confined between said enlarged head and said tray wall upper edge.

3. The carton of claim 2 wherein said locking slot in said top panel extends inwardly from an adjacent cover wall corresponding to the tray wall from which said locking tab projects, said slot including an enlarged head inwardly spaced from the adjacent cover wall and a narrow neck portion extending from said slot head to the adjacent cover wall, said tab head being joined to said tray wall upper free edge by a narrow neck, said slot head being sized to freely receive said tab head therethrough upon a closing of said cover, said tab being resiliently biased to align said tab neck within said slot neck portion upon passage of said tab head through said slot head whereby direct withdrawal of said tab from said slot is precluded.

4. The carton of claim 3 wherein said tray wall having said tab thereon is bowed slightly inward relative to said tray base panel, and said cover wall adjacent said slot is bowed slightly outward relative to said cover top panel to facilitate automatic alignment of said tab with said slot upon a closing movement of said cover.

5. The carton of claim 4 wherein said tray and said cover are each of a hexagonal configuration and wherein said walls of each include a front wall parallel to the corresponding rear wall, forward side walls extending from each front wall at obtuse angles thereto, and rear side walls extending at obtuse angles to the corresponding rear wall, said interlocking tray and cover lugs being at the angle defined between each front wall and the two adjacent forward side walls.

6. The carton of claim 5 wherein each of said forward side walls of said tray has a said locking tab projecting upwardly therefrom, said cover top panel having a said locking slot aligned with each of said tabs.

7. The carton of claim 1 wherein said tray and said cover are each of a hexagonal configuration and wherein said walls of each include a front wall parallel to the corresponding rear wall, forward side walls extending from each front wall at obtuse angles thereto, and rear side walls extending at obtuse angles to the corresponding rear wall, said interlocking tray and cover lugs being at the angle defined between each front wall and the two adjacent forward side walls.

8. The carton of claim 7 wherein each of said forward side walls of said tray has a said locking tab projecting upwardly therefrom, said cover top panel having a said locking slot aligned with each of said tabs.

9. A carton comprising a tray and a cover, a hinge joining said cover to said tray for selective pivotal movement of said cover between an open position remote from said tray and a closed position overlying and closing said tray; said tray and said cover each including a central panel with peripherally positioned walls joined to and projecting from the panel, said walls of each of said tray and said cover defining a generally circular configuration and having adjacent ends joined at obtuse angles and forming corners at peripherally spaced points about the corresponding panel, said peripheral walls of each of said tray and said cover including an inner wall, a front wall and side walls including forward side walls joined to said front walls, the inner walls of said tray and cover having upper edges joined along the length thereof and defining said hinge joining said tray and said cover, a locking lug extending generally coplanar from one end of one wall at each corner between each front wall and the adjacent forward side walls, each said lug intersecting and extending beyond the adjacent wall, the lugs on said cover being oriented to cross and releasably interlock with the lugs on said tray in said closed position of said cover, said tray forward side walls each having a free upper edge with an integral locking tab projecting upwardly therefrom, said central panel of said cover having a locking slot defined therethrough and receiving said tab when said cover is in said closed position, said tab interlocking with said cover central panel to preclude opening movement of said cover relative to said tray.

10. The carton of claim 9 wherein said free upper edges of said tray forward side walls, in the closed position of said cover, engage against and support said central panel of said cover.

11. The carton of claim 10 wherein said tray and said cover are folded from a unitary blank of material comprising a pair of similarly configured substantially hexagonal components integral along a common fold line therebetween.

* * * * *